US005992446A

United States Patent [19]

Tada

[11] Patent Number: 5,992,446

[45] Date of Patent: Nov. 30, 1999

[54] STOPPER SYSTEM FOR VESSEL ORIFICE

[75] Inventor: Shuji Tada, Higashimatsuyama, Japan

[73] Assignee: Prometron Technics Corp., Tokyo, Japan

[21] Appl. No.: 08/881,886

[22] Filed: Jun. 24, 1997

Related U.S. Application Data

[63] Continuation-in-part of application No. 08/650,297, May 20, 1996, Pat. No. 5,771,818.

[51] Int. Cl.[6] ..... F16L 7/00

[52] U.S. Cl. ..... 137/375; 251/144; 251/190; 251/243.6

[58] Field of Search ..... 137/340, 375; 251/144, 129.11, 158, 190, 191, 243.6

[56] References Cited

U.S. PATENT DOCUMENTS

| | | | |
|---|---|---|---|
| 1,597,068 | 8/1926 | Donald et al. | 251/158 |
| 1,706,123 | 3/1929 | McBride | 251/158 |
| 2,005,311 | 6/1935 | Belding | 137/340 |
| 2,238,814 | 4/1941 | Kneass, Jr. | 251/243.6 |
| 3,142,317 | 7/1964 | McVey | 137/375 |
| 3,411,528 | 11/1968 | Machiyama et al. | 137/340 |
| 4,314,688 | 2/1982 | Leman, Jr. | 251/158 |

*Primary Examiner*—A. Michael Chambers
*Attorney, Agent, or Firm*—Wood, Phillips, VanSanten, Clark & Mortimer

[57] ABSTRACT

The combination of a vessel and a stopper assembly. The vessel has a wall defining a storage space for a supply of a flowable material and an orifice on the wall communicating through the body from the storage space to externally of the storage space. The stopper assembly selectively blocks the orifice. The stopper assembly has a frame, a stopper element with a blocking surface on the frame that is movable relative to the vessel between i) a closed position wherein the blocking surface substantially blocks the orifice and ii) an open position, and a repositioning mechanism for moving the stopper element relative to the vessel with the stopper element remaining in the closed position to thereby avoid fixing of the stopper element to the vessel.

22 Claims, 11 Drawing Sheets

STOPPER SYSTEM FOR VESSEL ORIFICE

CROSS-REFERENCE

This application is a continuation-in-part of my co-pending application Ser. No. 08/650,297, filed May 20, 1996, entitled "Cooling System for Waste Disposal Device" issued on Jun. 30, 1998 as U.S. Pat. No. 5,771,818.

BACKGROUND OF THE INVENTION

1. Field of the Invention

This invention relates to vessels of the type having a discharge orifice therein and, more particularly, to a stopper system that allows the orifice to be selectively blocked.

2. Background Art

There are a multitude of different vessels having a discharge orifice which is required to be selectively opened and blocked. In some environments, a relatively simple valve structure can be utilized to accomplish this. However, the discharge of high temperature, pourable material may require a substantially different structure.

Relatively complicated valve mechanisms have been devised for molten metal vessels. These valves commonly utilize replaceable refractory elements. Operation of the valve may occur by relatively sliding refractory plates to selectively register openings therethrough.

While this type of refractory valve has proven effective in operation, it has a number of drawbacks. First of all, the refractory plates are prone to wearing after continued use as a result of which pouring characteristics may be changed and seals may be compromised.

In the event that replacement of paits in such a valve is required, the disassembly required to effect this replacement may be quite extensive and time consuming. This may result in significant down time.

A cruder method of controlling the state of vessel orifice involves the use of sand. Sand may be mounded at the orifice to prevent the discharge of molten metal or slag. When it is required to open the orifice, the sand is redistributed to expose the orifice.

When this operation is performed manually, it may be time consuming and fatiguing. Further, the operator of the valve is required to be positioned in close proximity to the high temperature vessel, thereby risking exposure to high temperatures and in a worse case the discharge of material.

Another option in the prior art for sealing a vessel orifice is to solidify the discharging material at the orifice. This can be done by cooling the region around the orifice. When it is desired to initiate flow through the orifice, the solidified material can be heated to a liquid state, thereby allowing flow out through the orifice.

Another available option is to utilize a stopper element which is loosely inserted into the orifice. The material in the vessel is allowed to flow around the stopper material and solidified to create a complete seal. When it is desired to release the material from the vessel, the stopper element is heated to melt the solidified material and allow the stopper to be removed to achieve a flow condition.

SUMMARY OF THE INVENTION

In one form, the invention contemplates the combination of a vessel and a stopper assembly. The vessel has a wall defining a storage space for a supply of a flowable material and an orifice on the wall communicating through the body from the storage space to externally of the storage space. The stopper assembly selectively blocks the orifice. The stopper assembly has a frame, a stopper element with a blocking surface on the frame that is movable relative to the vessel between i) a closed position wherein the blocking surface substantially blocks the orifice and ii) an open position, and a repositioning mechanism for moving the stopper element relative to the vessel with the stopper element remaining in the closed position to thereby avoid fixing of the stopper element to the vessel.

In one form, the orifice has a central axis and the stopper element moves substantially parallel to the central axis of the orifice between the open and closed positions.

The orifice may have a non-uniform cross section as viewed in cross section taken transversely to its central axis.

In one form, the orifice is bounded by a surface and with the stopper element in the closed position there is a gap between the blocking surface on the stopper element and the surface bounding the orifice.

The surface bounding the orifice may be annular with a central axis. The blocking surface of the stopper may be cylindrical with a central axis. The central axes of the blocking surface of the stopper and the surface bounding the orifice may be substantially coaxial.

In one form, the stopper element has a free end and the blocking surface of the stopper element is convex at the free end of the stopper element.

The repositioning mechanism may move the stopper element relative to the vessel in a reciprocating path.

In one form, the stopper element is movable in substantially a straight line between the closed and open positions and the repositioning mechanism pivots the stopper element relative to the vessel around the straight line.

In one form the stopper element has a body that is made up of at least one of a refractory material and a ceramic material.

In one form, the stopper element has a body with a passageway therethrough defining a predetermined path for the flow of a cooling liquid in heat exchange relationship with the stopper element body.

An inlet and an outlet can communicate with the passageway. A supply of cooling fluid under pressure may move through the inlet to and through the passageway to the outlet.

The stopper element body may have a removable portion on which the blocking surface is defined.

The invention contemplates that the above structure can be provided in combination with a molten material in the vessel storage space.

In another form, the invention contemplates a stopper assembly for an orifice on a vessel, which stopper assembly has a frame, a stopper element with a blocking surface on the frame that is movable relative to the frame between i) a closed position wherein the blocking surface is situated to block an orifice on a vessel and ii) an open position wherein the blocking surface is retracted from the first position, and a repositioning mechanism for moving the stopper element relative to the frame with the stopper element remaining in the closed position to thereby prevent fixing of the stopper element to the vessel.

DETAILED DESCRIPTION OF THE DRAWINGS

Figure 1:
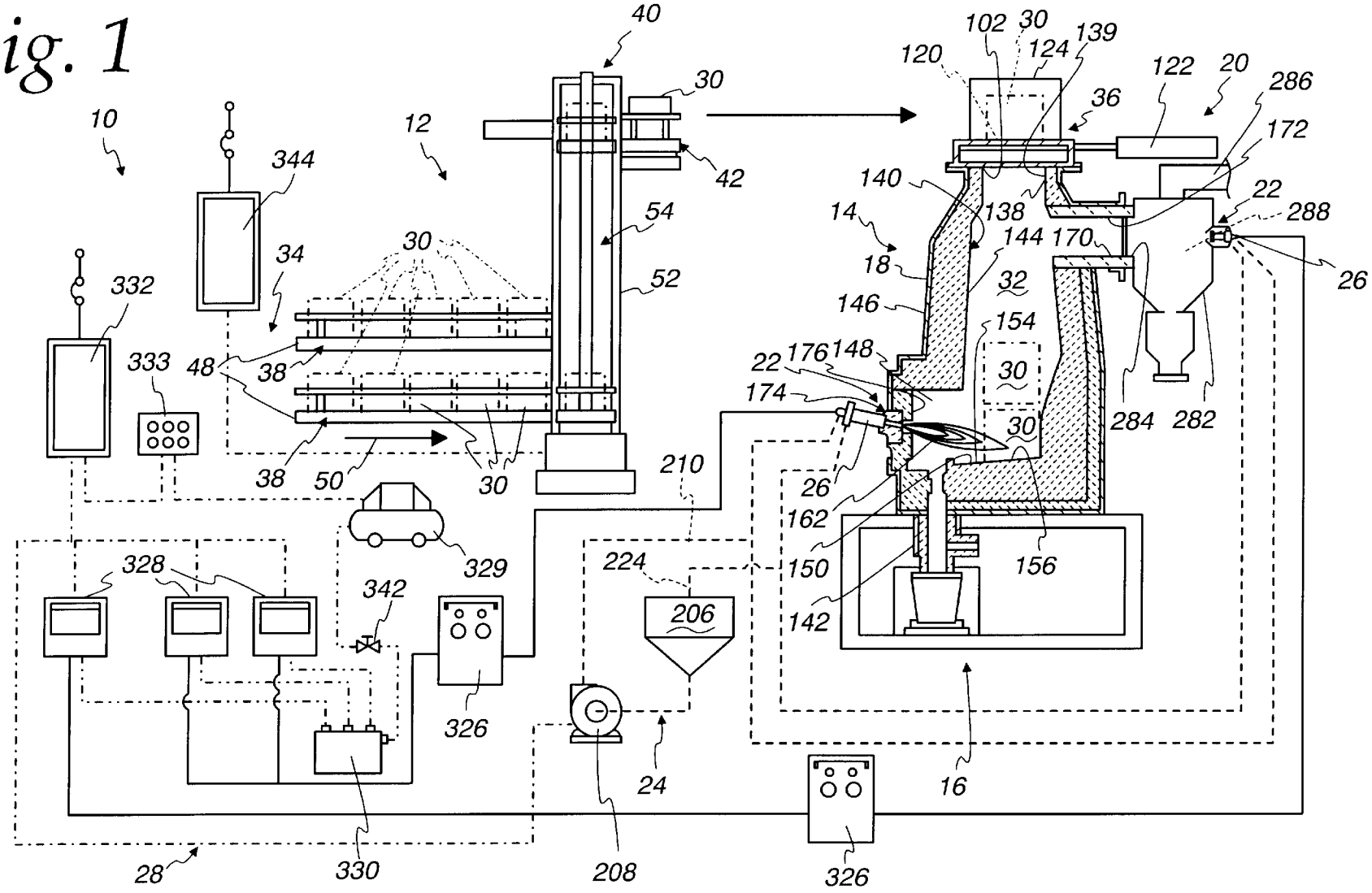
FIG. 1 is a front, schematic representation of a waste disposal system incorporating a waste disposal device, according to the present invention.
Figure 2:
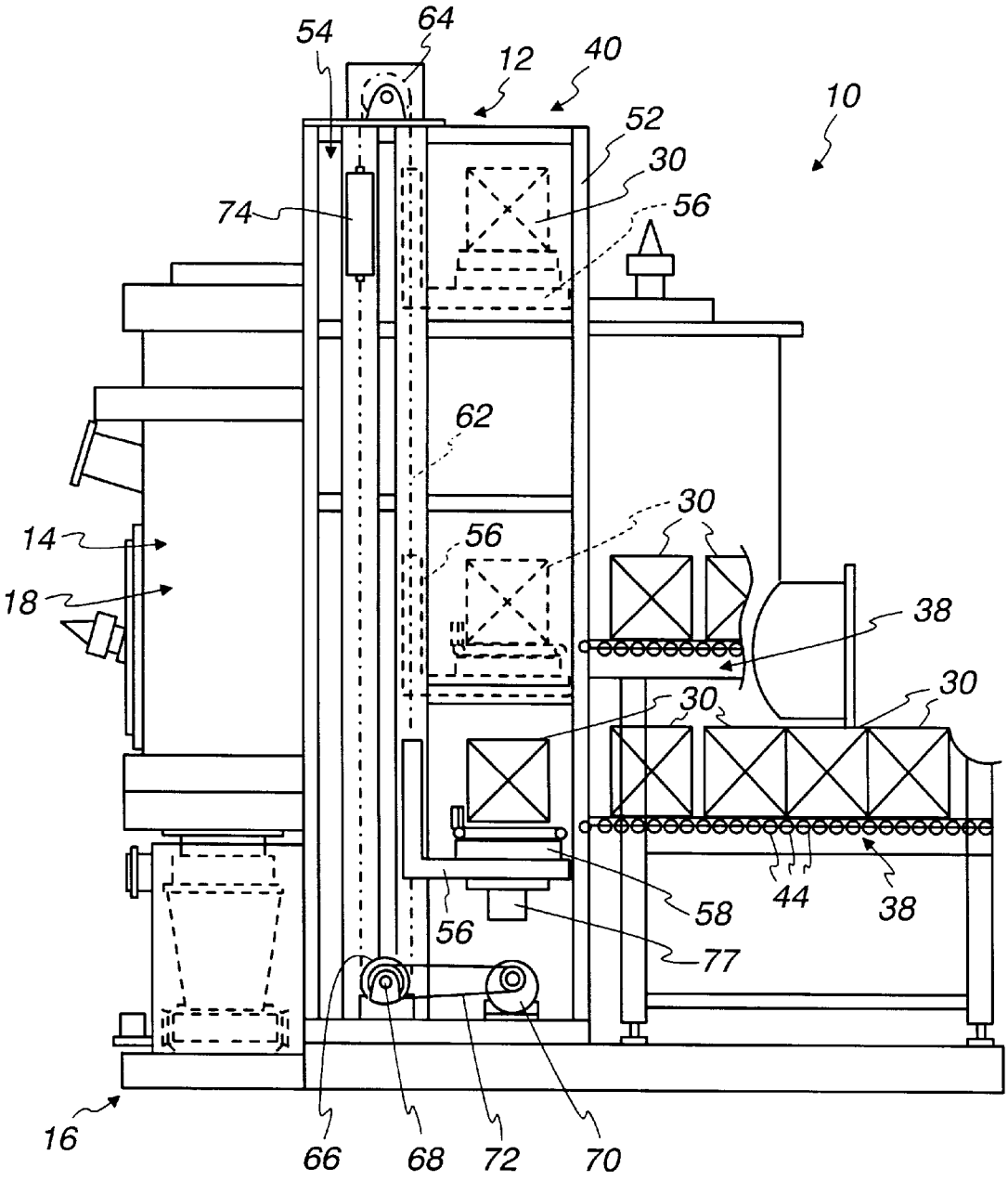
FIG. 2 is a schematic, side elevation view of the waste disposal system of FIG. 1.
Figure 3:
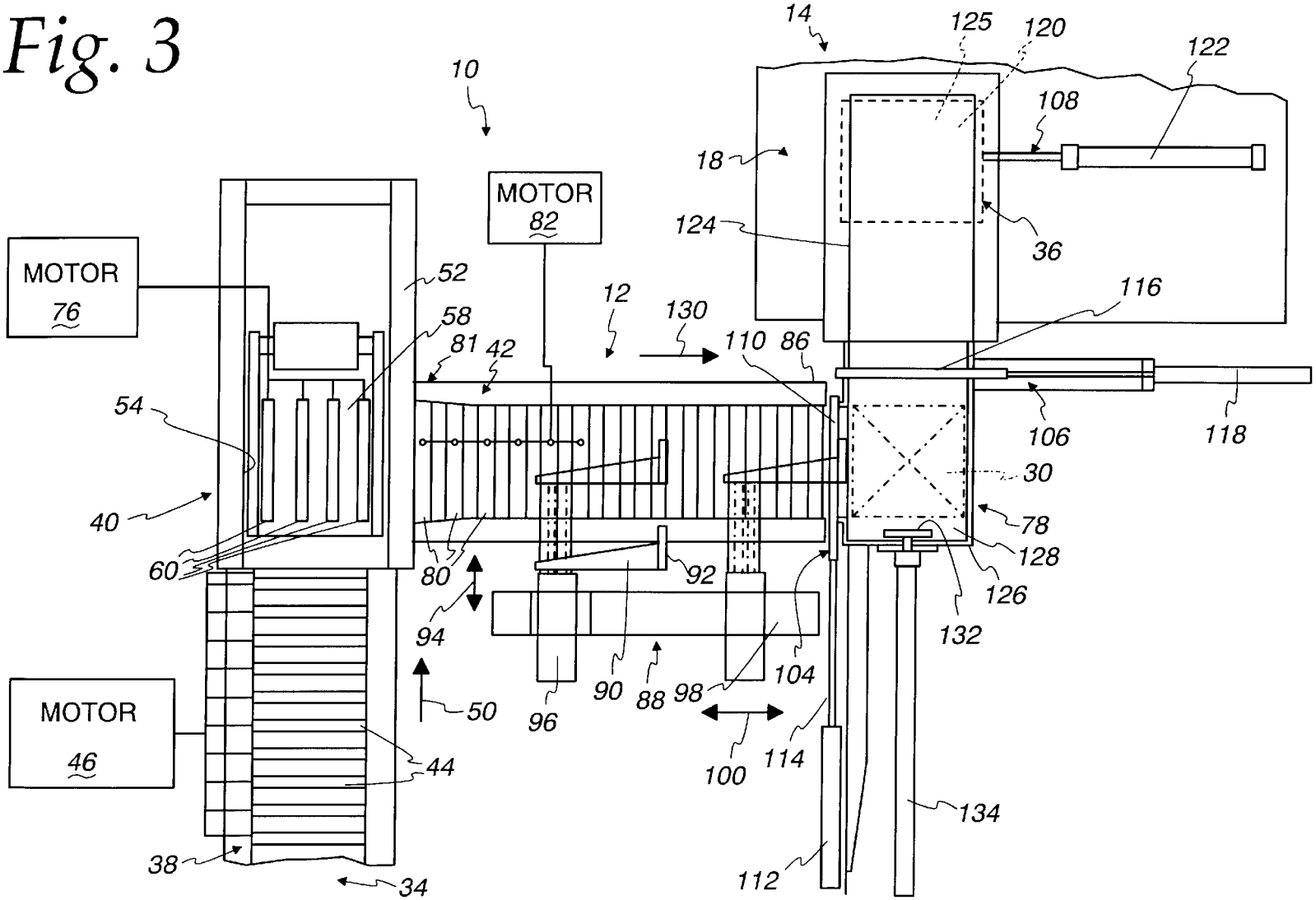
FIG. 3 is a schematic, fragmentary, plan view of the waste disposal system in FIGS. 1 and 2.
Figure 4:
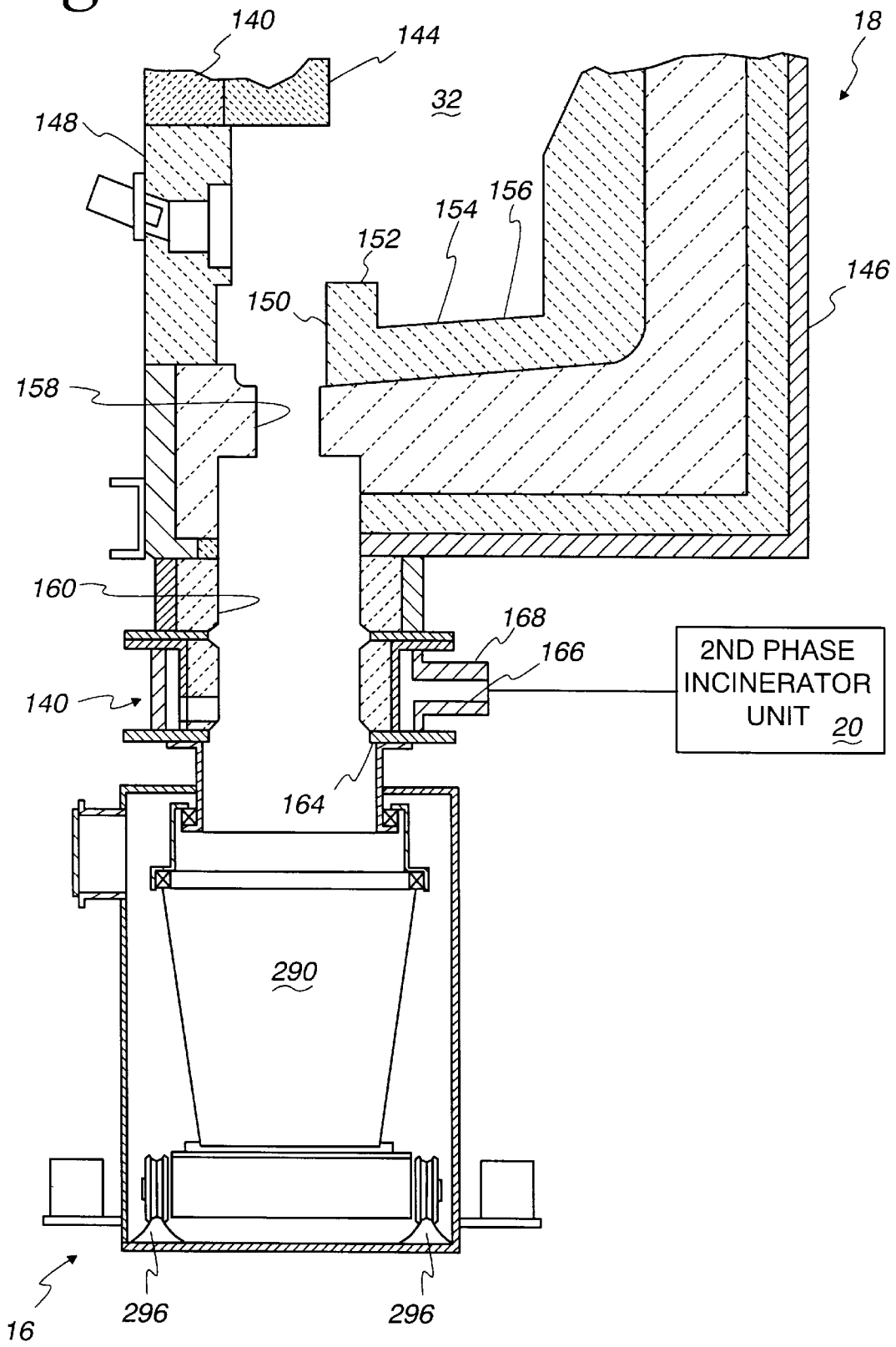
FIG. 4 is an enlarged, fragmentaiy, cross-sectional view of an incineration space and discharge nozzle on the waste disposal device in FIGS. 1–3.

Referring initially to FIGS. 1–3, a waste disposal system, suitable for incorporation of the present invention, is shown at 10. The waste disposal system 10 is made up of several cooperating subsystems, which will be separately described below. A waste feed subsystem at 12 delivers waste product to an incineration subsystem 14 in which the waste is reconstituted to slag, which is discharged in a molten state into a slag collection subsystem 16. The incineration subsystem 14 includes a waste disposal device 18 which performs as a primary, first phase incineration unit, and a second phase incineration unit at 20.

The present invention focuses principally upon a torch assembly 22, as part of the waste disposal device 18, which torch assembly 22 includes a cooling subsystem at 24. The operation of torches 26 on the torch assembly 22 is effected through a control subsystem at 28.

Briefly, the waste feed subsystem 12 delivers individual containers 30 with waste product therein to the top of the waste disposal device 18, from where the containers 30 are introduced to an incineration space/pyrolysis chamber 32. In the incineration space 32 the waste is reconstituted to slag that is discharged to the slag collection subsystem 16 and from there appropriately disposed of. Gas byproducts from the reconstitution are drawn off and treated in the second phase incineration unit 20. The control subsystem 28 coordinates the torch operation with the operation of the second phase incineration unit 20. During operation of the torches 26, a cooling liquid, preferably water, is circulated in heat exchange relationship with the torch assembly 22 through the cooling subsystem 24. Individual subsystems in the waste disposal system 10 will now be described separately in detail. It should be understood that the waste disposal device 18, while described in relationship to a specific arrangement of cooperating components, could be used according to the present invention in other environments.

Waste Feed Subsystem 12

The waste feed subsystem 12 is designed to serially convey waste filled containers 30 from an input location 34 to a delivery location at 36 atop the waste disposal device 18. The subsystem 12 is designed to convey containers 30 having a generally squared configuration. For safety and ecological reasons, the containers 30 are preferably made from a polyethylene based material, which type of container is readily commercially available. Incineration of this type of container 30 does not produce any significant harmful or toxic gas product.

The waste feed subsystem 12 has a pair of vertically spaced, input conveyors 38, an elevator section 40, and an output conveyor 42. A plurality of cylindrical, carrying rollers 44 on each conveyor 38 is driven by a motor 46 to thereby advance containers 30 from the input end 48 of each conveyor 38 in the direction of the arrow 50 to the elevator section 40.

The elevator section 40 has a frame 52 bounding a vertical conveying space 54 for the containers 30. The frame 52 guides an L-shaped lift platform 56 within the space 54 between a pickup position, shown in solid lines in FIG. 2 for the lower conveyor 38, and a discharge position, at the top of the space 54. The lift platform 56 carries a support plate 58, which in turn mounts a plurality of cylindrical conveying rollers 60 upon which the containers 30 can be supported.

An endless chain 62 is trained around vertically spaced sprockets 64, 66. The lower sprocket 66 is fixed to a shaft 68 which is driven by a motor 70 through a separate chain or belt 72. The motor 70 is operated to drive the chain 62 selectively in opposite directions to thereby raise and lower the lift platform 56, which is attached to the chain 62. A counterbalancing weight 74 is attached to the chain 62 to reduce the torque that must be generated by the motor 70 to advance the chain 62 to effect movement of the lift platform 56.

The conveying rollers 60 are driven by a motor 76 to effect transfer of the containers 30 from the input conveyor 38 to the output conveyor 42. The support plate 58 is pivotably attached to the lift platform 56 for rotation about a vertically extending axis. Rotational movement of the plate 58 can be imparted through a motor 77, whereby the orientation of the roller 60 can be changed to facilitate receipt and discharge of containers 30.

The output conveyor 42 directs containers 30 from the elevator section 40 to a transition location 78 at the height of the delivery location 36 i.e. at the top of the waste disposal device 18. The conveyor 42 has cylindrical carrying rollers 80, which rollers 80 on the upstream end 81 are driven by a motor 82. The rollers 80 on the downstream end 86 of the conveyor 42 are freely rotatable.

The conveyor 42 has an associated pusher system at 88. The pusher system 88 includes a cantilevered pusher aim 90 with a plate 92 thereon to engage the trailing end of the advancing containers 30 at the midportion of the conveyor 42. The pusher aim 90 is selectively extended and retracted transversely to the length of the conveyor 42, in the line of the double-headed arrow 94, by an air cylinder 96. A second air cylinder 98 is extended and retracted to move the air cylinder 96 and the arm 90 thereon in the line of the double-headed arrow 100, parallel to the length of the conveyor 42.

To advance a container 30 along the conveyor 42 with the pusher system 88, the cylinders 96, 98 are operated to move the arm 90 and plate 92 thereon downwardly and to the left in FIG. 3. By operating the cylinder 96, the pusher plate 92 is moved adjacent to the trailing end of a container 30 on the conveyor 42. By then operating the cylinder 98, the pusher plate 92 moves from left to right, thereby advancing the container 30 to the transition location at 78.

It should be understood that while rollers are shown on each of the conveyors 38, 42 and on the lift platform 56, these rollers could be replaced by any other known advancing mechanism, such as a chain or a rubber belt.

The containers 30 are maneuvered from the transition location 78 to the delivery location 36 and to and through an upper entry opening 102 on the waste disposal device 18 to the incineration space 32 by a series of cooperating damper systems 104, 106, 108.

The damper system 104 has a vertically extending blocking plate 110 that is movable by a cylinder 112 between a blocking position, shown in solid lines in FIG. 3, and a retracted position, out of the path between the conveyor 42 and the transition location 78. Extension and retraction of a rod 114 on the cylinder 112 effects this repositioning of the blocking plate 110.

The damper system 106 has a vertically extending blocking plate 116 which is placed selectively in a blocking position, as shown in solid lines in FIG. 3, and a retracted position, by operation of a cylinder 118.

The damper system 108 has a horizontally disposed blocking plate 120 which is repositioned through a cylinder 122 between a blocking position, wherein the blocking plate 120 seals over the entry opening 102, and a retracted position, wherein the entry opening 102 is exposed to allow delivery therethrough of a container 30 to the incineration space 32.

A shroud 124 is mounted over the entry opening 102 and defines a chamber 125 through which the containers 30 are passed as they are communicated to the entry opening 102. An additional shroud 126 defines a chamber 128 for the containers 30 at the transition location 78.

In operation, with the blocking plate 110 retracted, the containers 30 conveying in the direction of the arrow 130 on the conveyor 42 are discharged to the chamber 128. By retracting the next blocking plate 116, extension of a ram 132 upwardly in FIG. 3, through a pneumatic or hydraulic cylinder 134, causes the container 30 to be driven into the chamber 125 immediately over the entry opening 102. By retracting the blocking plate 120 through the cylinder 122, the containers 30 move under their own weight through the entry opening 102, and a neck 138 defining a passage 139 and the entry opening 102, to the incineration space 32. The entry opening 102 and neck passage 139 preferably have a cylindrical diameter which is large enough to allow the containers 30 to pass, without any appreciable resistance, to the incineration space 32.

Incineration Subsystem 14

The waste disposal device 18, as seen in FIGS. 1 and 4–9, has a wall structure 140 that bounds the incineration space 32 and defines a discharge nozzle 142 for communicating molten slag from the incineration space 32 to the slag collection subsystem 16. The internal surface 144 of the wall structure 140 bounding the incineration space 32 is defined by a fire resistant material. Suitable materials are an acid resistant material, such as $SiO_2$ or $TiO_2$, or chlorine base resistant MgO or CaO. The outer shell 146 on the wall structure 140 is preferably made from a non-magnetic material, such as stainless steel.

The high temperature melting/pyrolysis region 148 of the incineration space 32 is bounded by a stepped position 150 of the wall structure 140. An upwardly projecting ledge 152 on the stepped position 150 bounds a reservoir 154. Incoming containers 30 are funnelled through the incineration space 32 into the reservoir 154 to against an upwardly facing surface 156 bounding the reservoir 154. The surface 156 is inclined downwardly toward the ledge 152 and an adjacent outlet opening 158 in communication with a discharge passage 160 defined by the discharge nozzle 142. The containers 30 stacked in the reservoir 154 are strategically located to be impinged upon by the heat from the torches 26.

In a preferred form, the torches 26 are plasma torches which generate a plasma arc 162 that causes melting of the containers 30 and the contents thereof. When sufficient masses of the material are reconstituted to slag in the reservoir 154, the slag depth exceeds the height of the ledge 152 so that the slag flows over the ledge 152, through the outlet opening 158 and the discharge passage 160 on the nozzle 142, and to the outlet end 164 of the nozzle 142. The discharge of slag from the reservoir 154 to the outlet opening 158 is further facilitated by the development of suction in a passageway 166 defined by a fitting 168, which passageway 166 is in communication with the discharge passage 160 on the discharge nozzle 142. The suction developed in the fitting passageway 166 draws exhaust gas from the high temperature melting region 148, from where it is communicated to the second phase incineration unit 20.

Exhaust gas at the upper region of the incineration space 32 is drawn off through a conduit 170. The exposed annular surface 172 of the conduit 170 is made preferably from the same fire resistant material as is the internal surface 144 bounding the incineration space 32.

Figure 6:
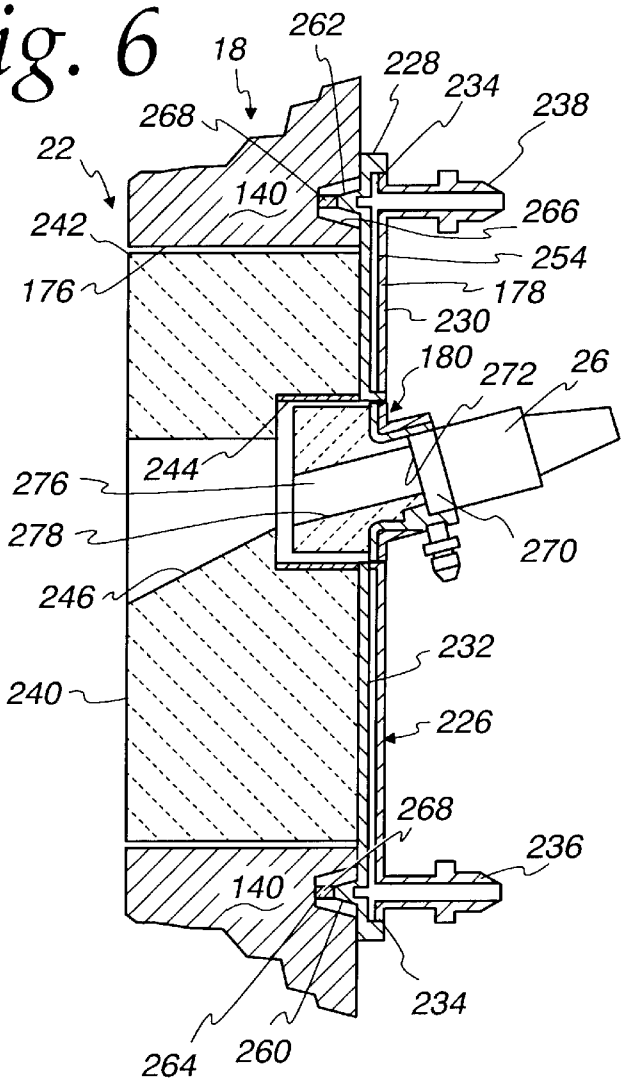
FIG. 6 is a cross-sectional view of the torch assembly taken along line 6—6 of FIG. 5.
Figure 5:
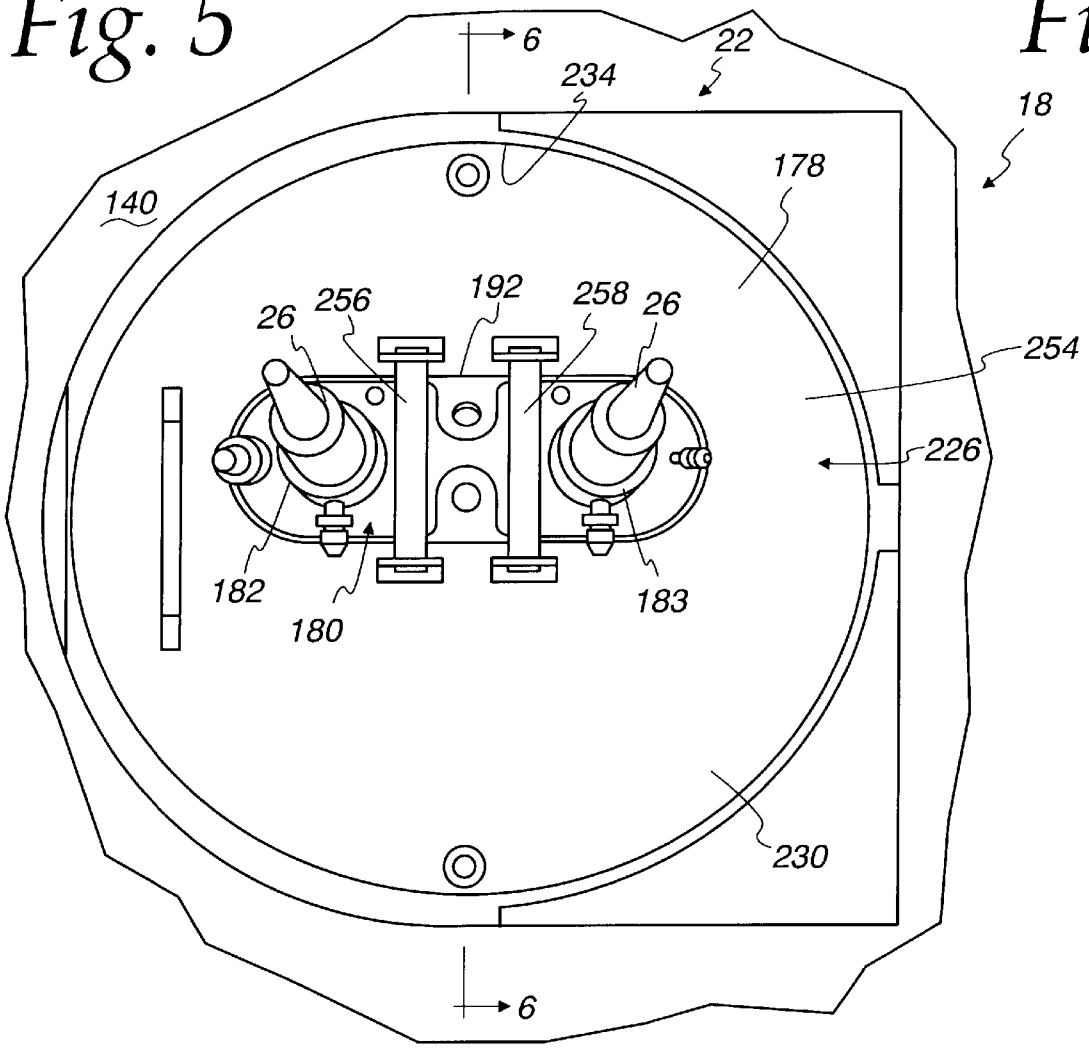
FIG. 5 is an enlarged, elevation view of a torch assembly on the waste disposal device, according to the present invention.
Figure 9:
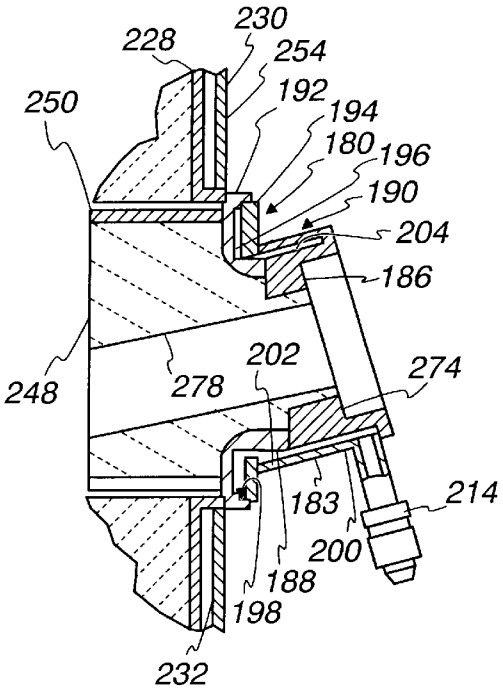
FIG. 9 is a cross-sectional view of the torch holder taken along line 9—9 of FIG. 7.

According to the invention, the torch assembly 22 is removably attached to the wall structure 140 in an opening 176 therethrough. The torch assembly 22, as seen most clearly in FIGS. 1 and 5–9, consists of a base plate 178 and a torch holder 180 that is removably mounted to the base plate 178 in an operative position thereon, as shown in FIGS. 1, 5 and 6. The torch holder 180 has protruding, cylindrical elements 182, 183 having recessed seats 184, 186, respectively, to each accommodate a single torch 26. The torch holder 180 is designed to maintain a pair of torches 26 in a preferred angular relationship to each other and the high temperature melting region 148 within the incineration space 32.

Another aspect of the invention is the provision of a self-contained cooling system in the torch assembly 22. In a preferred form, the base plate 178 and torch holder 180 are made with cooling systems that are both independent of each other and independent of the wall structure 140 on the waste disposal device 18.

More particularly, the cooling structure defines a means for circulating a cooling fluid in heat exchange relationship with each of the base plate 178 and torch holder 180. In the case of the torch holder 180, a flow passage 188 for cooling liquid is defined by a metal frame 190. The metal frame 190 is defined by a plurality of welded metal parts. First and second substantially flat frame parts 192, 194 are nested, one within the other, with a space 196 being maintained therebetween to define a part of the flow passage 188. The frame parts 192, 194 are welded along a seam 198. Exemplary cylindrical element 183 is formed in pail by a cylindrical frame part 200 having an inner end 202 that is welded to the flame part 194. An annular space 204 is maintained fully around the cylindrical frame part 200 and communicates with the space 196 to make up a part of the flow passage 188.

A cooling liquid, and preferably water from a supply 206, is pressurized by a pump 208 and delivered through an inlet conduit 210 from the pump 208 to each of three inlet nozzles 212, 214, 216 on the torch holder 180, through the passage 188 in heat exchange relationship with the metal frame 190, and is returned via outlet nozzles 218, 220, 222, and through a return conduit 224 to the water supply 206.

The cooling system on the base plate 178 is also defined by a metal frame 226, including flat parts 228, 230, which form bounding walls for a flow passage 232 therebetween. The wall parts 228, 230 are joined at a seam 234 by welding. An inlet nozzle 236 communicates cooling liquid from the inlet conduit 210 to the passage 232 and to an outlet nozzle 238, which is attached to the return conduit 224.

Each of the frames 190, 226 is embedded in a fire resistant, refractory material. The base plate frame 226 has a refractory body 240 that is complementary in size and shape to the opening 176 through the wall structure 140. A metal band 242 surrounds the refractory body 240 and is welded to the back of the wall part 228. The refractory body 240 has a recessed seat 244 formed therein for accepting the torch holder 180 and an opening 246 for the torches 26 that diverges inwardly. A slight space is shown between the torch holder 180 and seat 244 for clarity. This space is absent in the preferred embodiment.

The torch holder 180 has a refractory body 248 and a surrounding metal band 250 with an oval shape that is matched to the seat 244 in the base plate 178. The metal band 250 is welded to the frame part 192 so that an inwardly facing shoulder 252 is formed around the circumference of the metal band 250. With the torch holder 180 in an operative position on the base plate 178, the shoulder 252 abuts to the outwardly facing surface 254 on the base plate 178. A pair of mounting brackets 256, 258 maintain the torch holder 180 in its operative position on the base plate 178. Through this arrangement, the torch holder 180 is removably maintained in the operative position on the base plate 178.

The base plate 178 is in turn removably maintained in its operative position on the wall structure 140. To assure proper alignment of the base plate 178 on the wall structure 140, projections 260, 262 are formed on the metal frame 226 for reception in complementary recesses 264, 266 in the wall structure 140. A packing material 268 is placed between the projections 260, 262 and the wall structure 140 in the recesses 264, 266.

The base plate 178, with this arrangement, seals the wall structure opening 176. The cooperating projections 260, 262 and recesses 264, 266 assure that the base plate 178 is consistently aligned in the opening 176. The oval torch holder 180 is in turn consistently aligned in its operative position on the base plate 178.

Figure 7:
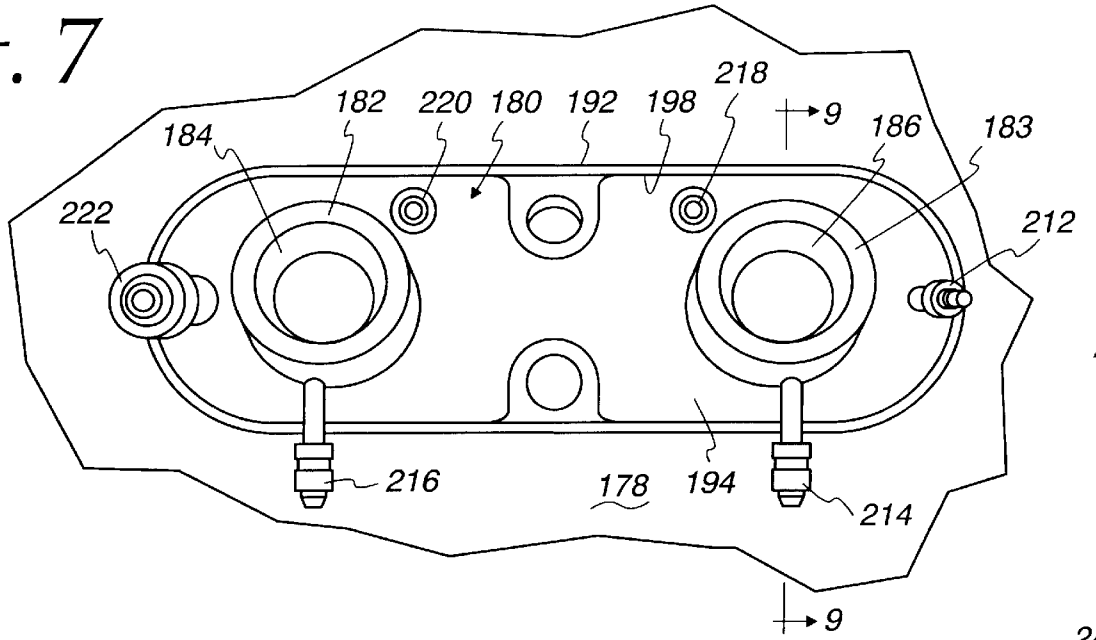
FIG. 7 is an enlarged, elevation view of a torch holder on the torch assembly of FIGS. 5 and 6.
Figure 8:
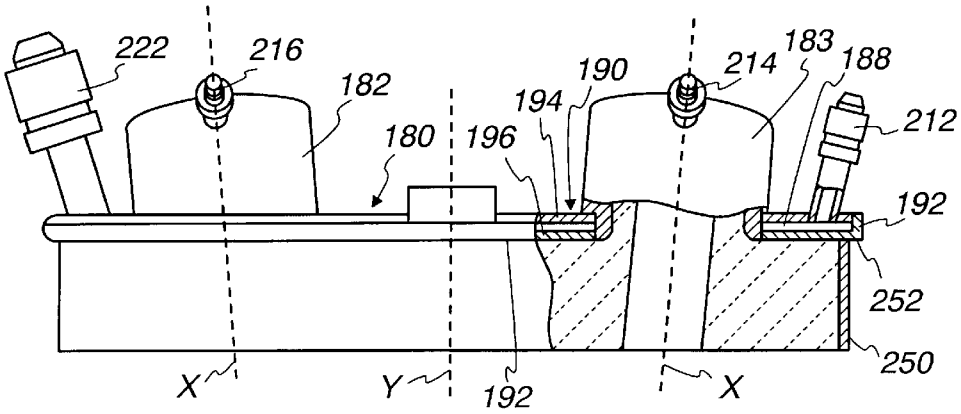
FIG. 8 is an enlarged, bottom view of the torch holder in FIG. 7.
Figure 11:
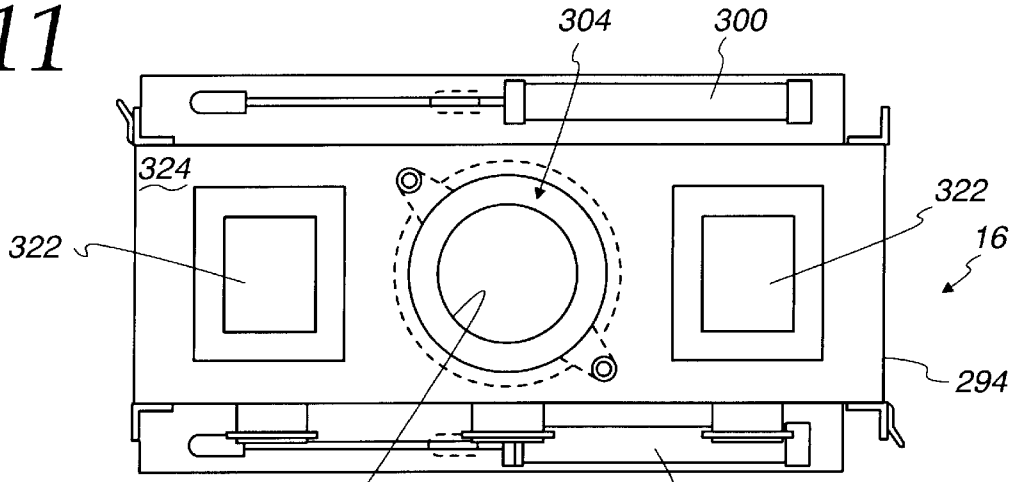
FIG. 11 is a plan view of the molten slag collection unit in FIG. 10.
Figure 10:
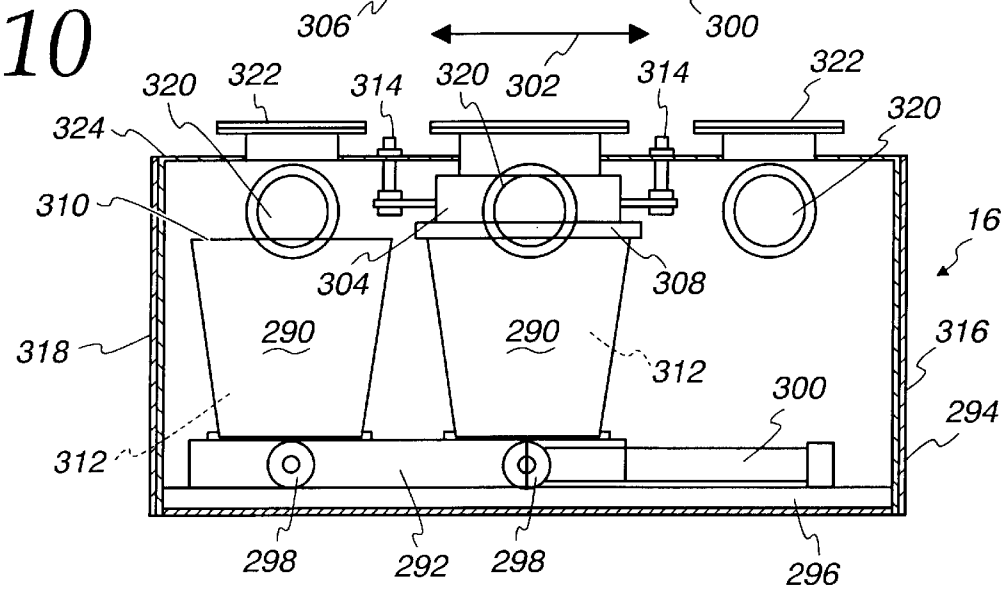
FIG. 10 is an elevation view of a molten slag collection unit on the waste disposal system of FIGS. 1–3.
Figure 12:
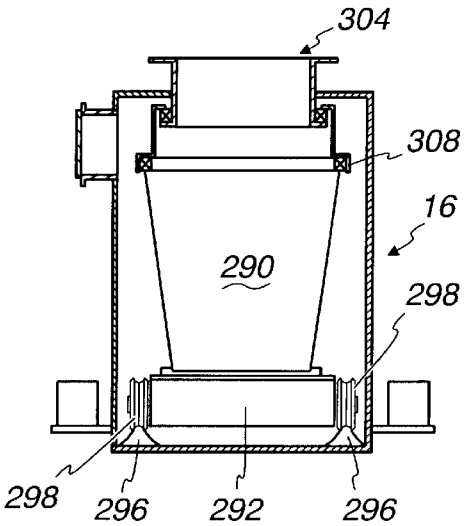
FIG. 12 is a side elevation view of the molten slag collection unit of FIGS. 10 and 11.
Figure 13:
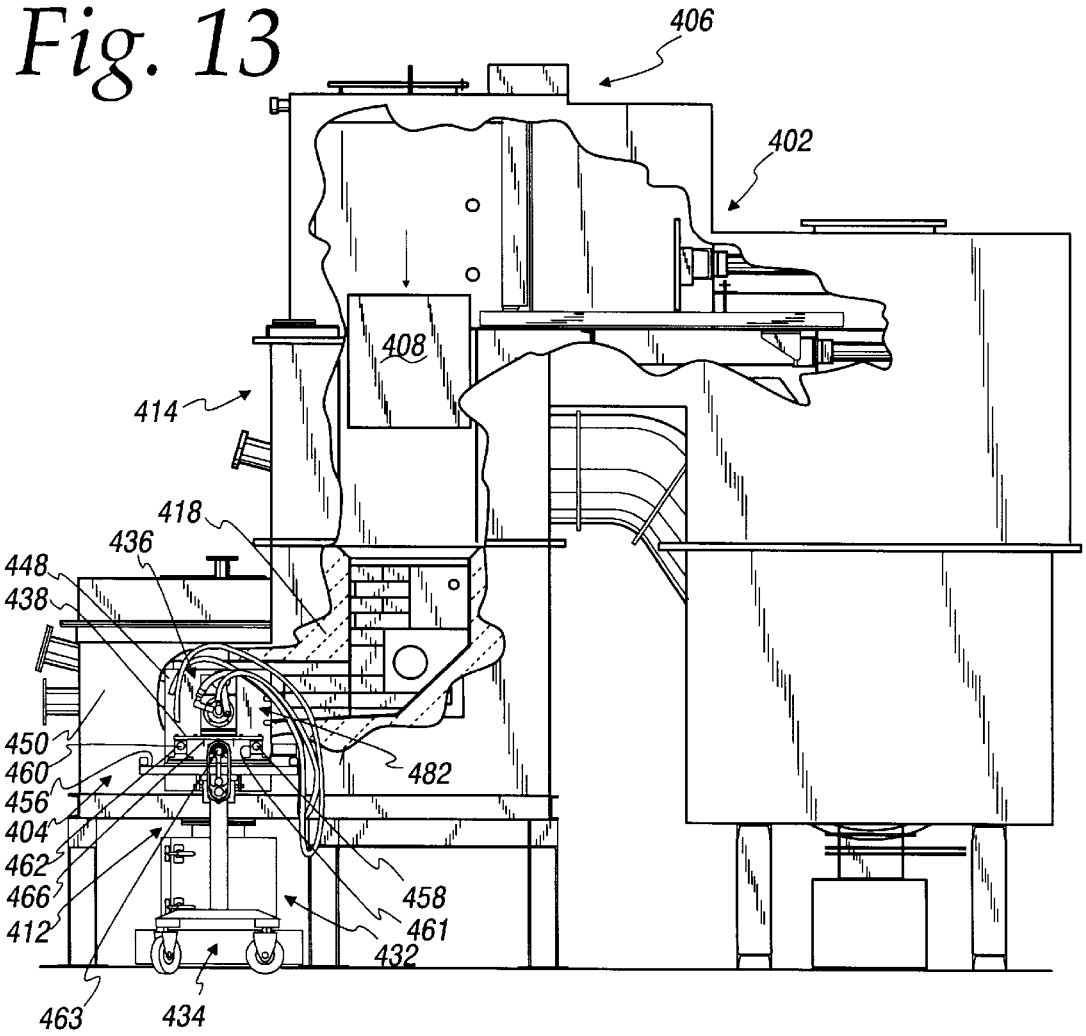
FIG. 13 is a side elevation view of a modified form of waste disposal system with a stopper system for an orifice, through which molten slag is selectively allowed to flow, according to the present invention.
Figure 14:
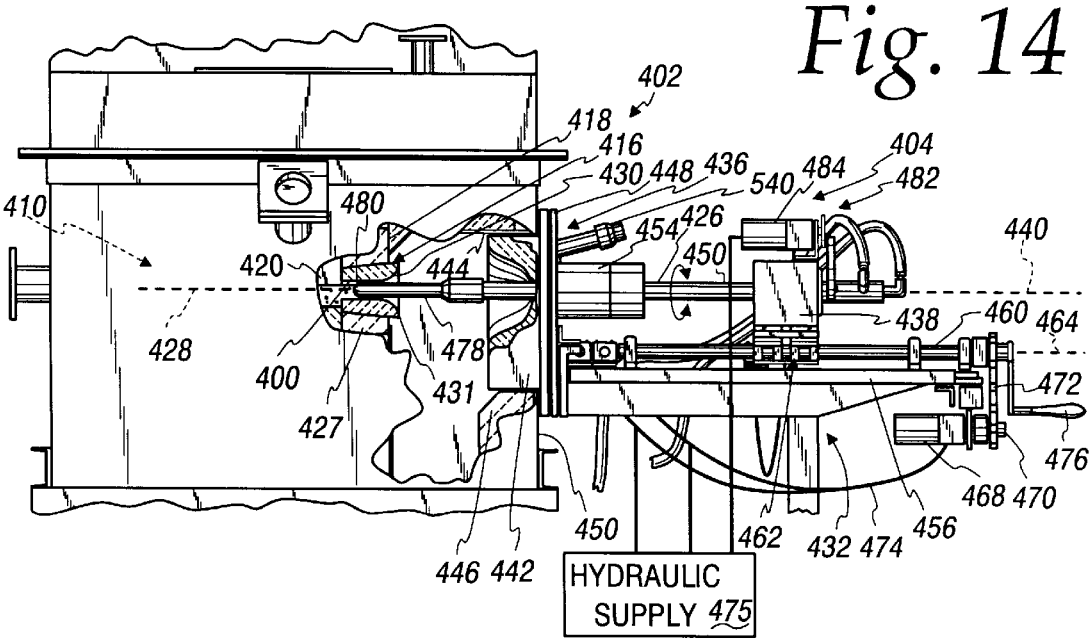
FIG. 14 is an enlarged, fragmentary, front elevation view of the stopper system in FIG. 13 with a stopper element on the stopper system in a closed position.

The torches 26 are removably placeable in the seats 184, 186 in the cylindrical elements 182, 183. The exemplary seat 186 closely accepts a radially enlarged portion 270 of the torch 26. With a shoulder 272 on the torch portion 270 abutting to the bottom surface 274 of the seat 186, a reduced diameter portion 276 of the torch projects into a through opening 278 in the refractory body 248 and is closely surrounded thereby. As seen in FIG. 7, the central axis X for the cylindrical element 182 is angled to a greater extent than the central axis $X^1$ for the cylindrical element 183 is relative to a plane Y bisecting the torch holder 180. Precise alignment of the torches 26 on the torch holder 180 is assured by this arrangement.

With the above structure, the torch assembly 22 is cooled in close proximity to the areas where the most intense heat is generated by the torches 26. The systems for cooling the torch holder 180 and base plate 178 are independent of each other and of the wall structure 140. Accordingly, if for any reason either of the cooling systems needs to be repaired or replaced, the operator can simply separate the torch holder 180 from the base plate 178 and/or the base plate 178 from the wall structure 140. This obviates the need to have the service person physically enter the incineration space 32 to access the cooling systems. Additionally, the repair person can effect repairs without waiting for the entire system to cool down, as would be required if access to the incineration space would be necessary. In the event of a failure of part or all of either of the cooling systems, either system can be independently repaired.

Further, the systems are designed so that the welds, which are used to join the parts of the metal frames 190, 226, are located either within the thickness of the wall structure 140 or at the exterior thereof. In either event, the welds are not directly exposed to the intense heat in the high temperature melting region 148. As seen, for example, in FIG. 9, the weld between the cylindrical element 183 and the frame part 194 and the weld between the frame parts 192, 194 are located externally of the wall structure 140. The weld between the metal band 250 and the frame part 192 is located in the opening 176, i.e. within the thickness of the wall structure 140, adjacent to the outside thereof. In FIG. 6, the weld at the seam 234 is on the exterior of the wall structure 140, with the weld between the metal band 242 and the frame part 228 residing within the thickness of the wall structure 140, adjacent the outside thereof.

Thus, the likelihood of failure or cracking of welds is minimized by reason of not having direct exposure of these welds to the intense heat within the high temperature melting region 148. In the event of a failure, the metal part is readily accessed by removing the torch assembly 22.

The above arrangement also facilitates precise mounting and removal of the torches 26. In the described arrangement, the torches 26 are removably mountable consistently in the proper orientation with respect to the incineration space 32.

The torches 26 are preferably plasma torches with a space formed between a base anode and tip cathode. The differential between the anode and cathode generates the plasma arc 162 in the high temperature melting region 148. Compressed air is supplied to the region where the arc is developed. While compressed air can be used as the process gas, it is also known to use Ar, $N_2$, $CO_2$, or $H_2$, or a mixture of these gases.

In a preferred form, backup burners are mounted in the incineration space 32 and are aligned to be parallel to the arc 162. With this arrangement, the temperature at the reservoir 154 in the incineration space is on the order of 1500–1600° C. By changing the angle of the backup burners, the arc from the backup burners may spiral as it interacts with the arc from the torches 26.

The second phase incineration unit 20 incorporates a like torch assembly 22 in a wall structure 282 formed generally in the same manner as the wall structure 140, but on a smaller scale. The wall structure 282 has an input opening 284 to receive exhaust gases from the fitting passage 166 and the conduit 170. An exhaust duct 286 releases the harmless end product after the exhaust gases are combusted in the treatment space 288 within the wall structure 282. All surfaces which are exposed to the high temperature exhaust gas are made of a fire resistant material.

The torch assembly 22 associated with the second phase incineration unit 20 is constructed, mounted, and cooled in the same manner as the torch assembly 22 on the first phase incineration unit.

Preferably, backup burners are also used in the second phase incineration unit 20 to produce a temperature above 850° C. to effectively combust the exhaust gases. The angle of the backup burners can be controlled to produce the previously described spiral effect.

Slag Collection Subsystem 16

The slag collection subsystem 16, shown in FIGS. 1 and 10–12, consists of two, or more, collection buckets 290 mounted on a carriage 292 that is translatable guidingly within a container 294 on a pair of guide rails 296. The carriage 292 has wheels 298 which ride along the top of the rails 296. Air cylinders 300, acting between the container 294 and carriage 292, are extendable and retractable to move the carriage 292 in the line of the double-headed arrow 302. The carriage 292 is dimensioned to accommodate two of the buckets 290, as seen clearly in FIG. 10.

The container 294 has a central lid assembly 304 with a central feed passage 306 defined therethrough. The lid assembly 304 includes a lower rim 308 that can be engaged closely to the upper edge 310 of each bucket 290 so that the feed passage 306 is in communication with the internal storage space 312 defined by each bucket 290. Through rotatable screws 314 or other suitable vertical repositioning mechanism, the lid assembly 304 can be raised and lowered relative to a subjacent bucket 290.

In operation, the container 294 is situated beneath the waste disposal device 18 so that the discharge nozzle 142 aligns vertically directly over the feed passage 306. The lid assembly 304 is lowered through the screws 314 to the operative position shown in FIG. 10. When a predetermined amount of molten slag has accumulated in the active bucket 290, the lid assembly 304 is elevated. The carriage 292 is then shifted to the right in FIG. 10 to situate the empty bucket 290 beneath the lid assembly 304. As this occurs, the filled bucket 290 moves adjacent to a hinged access door 316, which can be opened to remove the filled bucket 290. After the next bucket 290 is filled, the carriage 292 is shifted to the left in FIG. 10 so that the empty bucket 290 is underneath the lid assembly 304 and the filled bucket is situated adjacent to a separate hinged access door 3 18, which can be opened to empty that bucket 290.

Windows 320 allow viewing of the contents of the buckets 290 in each of three different positions within the container 294. Lights 322 in the top wall 324 of the container 294 illuminate the region over the containers 290 to facilitate viewing of the contents thereof through the windows 320.

Control Subsystem 28

Ignition systems for the plasma torches 26 are shown at 326 in FIG. 1. An electrical power generator 328 supplies the ignition systems 326 and an air compressor 329, which compresses the processing gas for the torches 26. A flow regulator 330 controls the delivery of the processing gas. Through a control panel 332, the operation of the water pump 208 and power generator 328 is controlled.

The air compressor 329 also supplies pressurized air to operate the air cylinders 96, 98 associated with the pusher system 88 (FIG. 3), the air cylinders 300, associated with the slag collection system 16 (FIGS. 10–12), and the cylinder 134 on the waste feed subsystem 12 (FIG. 3). A valve 342 opens and closes an air passage through which the flow regulator 330 delivers gas. All of the air cylinders could be replaced by hydraulic cylinders, in which event an hydraulic pump would be substituted for the air compressor 340. A separate control panel 344 is provided for the waste feed subsystem 12.

Overall Operation

Waste, such as hospital waste that has been contaminated by blood and/or urine, is placed in the containers 30. The containers 30 are placed on the input conveyor 38 and transferred to the elevator section 40, raised to the height of the output conveyor 42, and transferred thereto by operating the motor 76 to rotate the rollers 60. The drive motor 82 is operated to advance the containers 30 along the output conveyor 42 to the point that they are picked up by the plate 92 on the pusher assembly 88. The blocking plate 110 is retracted to allow the containers to advance into the transition chamber 128. The blocking plate 110 is placed in the blocking position and the blocking plate 116 is retracted. The cylinder 134 is operated so that the ram 132 advances the containers 30 into the chamber 136 immediately over the blocking plate 120. The blocking plate 116 is then placed in a blocking position and the blocking plate 120 retracted to allow the containers 30 to pass through the entry opening 102 and into the incineration space 32. The blocking plate 120 is then placed in a blocking position to cover the entry opening 102. The containers 30 accumulate in the high temperature melting region 148. A plasma region is developed by the torches 26 to reconstitute the containers 30 and the waste therein. The efficiency of reconstitution is improved by the provision of backup burners, whereby the treatment temperature reaches 1500–1600° C. The containers 30 and the contents thereof are thus reconstituted to molten slag.

The exhaust produced by this reconstitution is burned by the plasma arc within the incineration space 32. Any of the exhaust gas that is not completely broken down in the incineration space 32 is delivered to the second phase incineration unit 20 via the conduit 170 and the passage 166. In the second phase incineration unit 20, a plasma region is created through a similar torch assembly 22 and backup burners. Preferably, the temperature resulting from the combined effect of the torches 26 and backup torches reaches 850° C. Through this high temperature combustion, the gases are detoxified, the black soot particles from the smoke are eliminated, and the production of dioxins is controlled. A harmless gas results that can be safely discharged to the atmosphere.

Since toxins such as HCl and SOx are eliminated from the gas ultimately exhausted at the duct 286, an additional treatment step can be performed as need dictates. The treated gas can be cooled to 55° C. through a shower in a coolant tower. Additional particles may be eliminated through the use of a cyclone dryer or scrubber. This step can be skipped depending upon particle contamination. After that, dioxins can be removed through an alkali wash or charcoal filtering. The resulting exhaust gas is virtually harmless to the environment.

As the containers 30 and the contents thereof are reconstituted, slag accumulates in the reservoir 154. Eventually, the slag accumulates to the height of the ledge 152 and spills over into the outlet opening 158 and passes through the passage 160 in the discharge nozzle 142. The discharging, molten slag, continues to be heated through the high temperature exhaust that is drawn through the passageway 166 in the discharge nozzle 142.

The discharging slag is accumulated in the buckets 290, which are monitored and removed as they are filled.

In the event that the torch assemblies 22 are in need of repair or replacement, through a simple command from the control 332, the torches 26 can be turned off and the entire system operation interrupted. The entire torch assembly 22 can then be removed and worked upon without entering the incineration space 32.

It is contemplated that many variations of the above system can be incorporated without departing from the spirit of the invention. For example, a simple hopper system can be substituted for the waste feed subsystem 12, described above. Steps that are canied out automatically in the above system 10 can be carried out fully or partially manually. The number of damper systems 104, 106, 108 described is a matter of design choice. The molten slag can be continuously conveyed away on conveyors. All of the above are examples of contemplated variations.

DESCRIPTION OF THE PREFERRED EMBODIMENT

Referring now to FIGS. 13–19, a stopper assembly for selectively blocking an orifice 400 on a waste disposal system at 402 is shown generally at 404.

The waste disposal system 402 has the same general construction and functions substantially in the same manner as the waste disposal system 10, described above. The waste disposal system 402 is used to demonstrate one particularly suitable environment for use of the stopper assembly 404. It should be understood, however, that the stopper assembly 404 has a more universal application and can be used to selectively block an orifice on virtually any type of vessel that is used to contain a flowable material.

Figure 15:
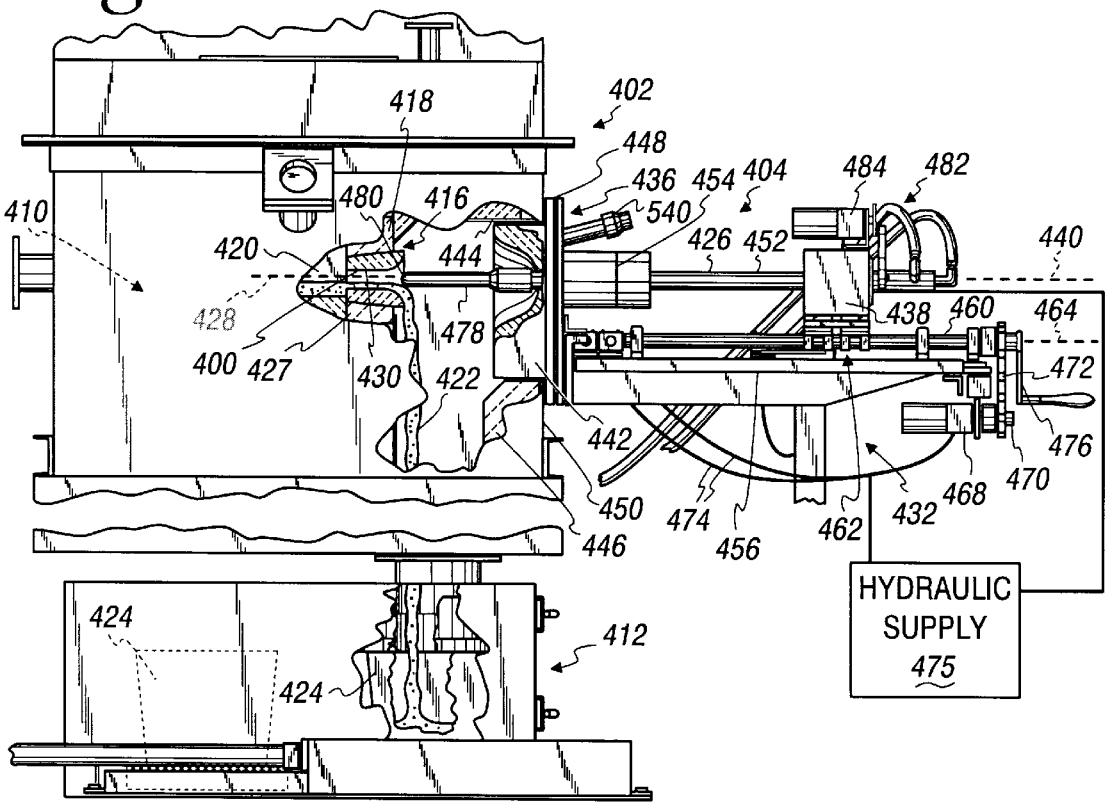
FIG. 15 is a view as in FIG. 14 with the stopper element in an open position.
Figure 16:
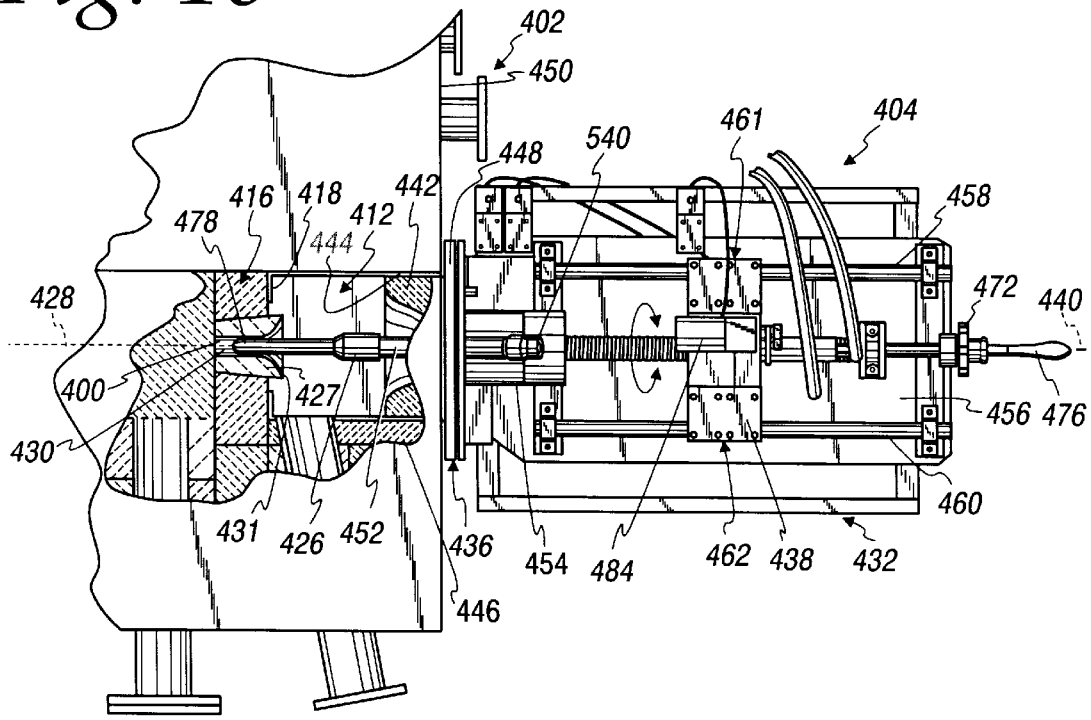
FIG. 16 is an enlarged, fragmentary, plan view of the waste disposal system of FIGS. 13–15 with the stopper element on the stopper system in the closed position.

Generally, the waste disposal system 402 has a waste feed subsystem 406 for controllably delivering waste product 408 to an incineration space/pyrolysis chamber 410 in which the waste product 408 is reconstituted to molten, flowable slag that is selectively allowed to flow through the orifice 400 to a waste collection subsystem 412. This reconstitution may be carried out through an incineration subsystem 414 that is similar to the incineration subsystem 14, previously described. The incineration subsystem 414 includes an internal vessel 416 defined by a refractory wall structure 418 which bounds a storage/accumulation space 420 for molten by-product from the reconstituted waste product 408. Molten material 422 accumulated in the storage/accumulation space 420 is allowed to flow gravitationally through the orifice 400 to serially aligned vessels 424 associated with the waste collection subsystem 412. The stopper assembly 404 has a stopper element 426 that is selectively repositionable between an open position, as shown in FIG. 15, wherein molten material 422 is allowed to flow from the space 420 through the orifice 400, and a closed position, shown in FIGS. 14 and 16, wherein flow of the molten material 422 from the space 420 through the orifice 400 is blocked.

A refractory insert 427 is mounted in the wall structure 418 and defines the orifice 400. The orifice 400 has a central axis 428 and a non-uniform area, as viewed in cross section taken orthogonally to the axis 428, along the axial extent of the orifice 400. The orifice 400, as so viewed, has a substantially uniform, circular, cross-sectional area over substantially the entire thickness of the wall 418. The surface 430 on the insert 426 bounding the orifice 400 flares outwardly toward the outlet end 431 thereof to produce a progressively increasing cross-sectional area for the orifice 400 outside of the wall structure 418.

The stopper assembly 404 has a frame 432 with a wheeled undercarriage 434 which allows the frame 432 to be conveniently repositioned relative to the remainder of the waste disposal system 402, thereby facilitating operative positioning of the stopper assembly 404 and repair of both the stopper assembly 404 and the region of the waste disposal 402 in the vicinity of the orifice 400 by movement of the stopper assembly 404 away from the remainder of the waste disposal system 402.

The stopper element 426 is elongate and spans between an end support 436 and a carriage 438 that is movable parallel to the lengthwise central axis 440 of the stopper element 426 relative to the frame 432 to effect repositioning thereof, as described in detail below.

The end support 436 has an insert portion 442 which fits closely within a complementary opening 444 in an outer wall structure 446 extending around and spaced from the vessel 424. An enlarged, peripheral flange assembly 448 on the end support 436 abuts to the outer surface 450 of the outer wall structure 446 with the stopper assembly 404 in the operative position of FIGS. 15–16. The end support 436 can be suitable secured in its operative position as by means similar to that used to secure the torch assembly 22, previously described.

The body 452 of the stopper element 426 is journalled for rotation within a bearing assembly 454 for rotation about the axis 440. The bearing assembly 454 also allows the body 452 to shift guidingly relative to the bearing assembly 454 along the axis 440.

The frame 432 has a bed element 456 which supports spaced, parallel go guide rails 458, 460 in an elevated position thereabove. The guide rails 458, 460 extend one each through depending guide frames 461, 462 on the carriage 438 to guide translatory movement of the carriage 438 parallel to the stopper element axis 440, to thereby reposition the stopper element 426 between the open position of FIG. 15 and the closed position of FIGS. 14 and 16.

Movement of the carriage 438 is effected through a threaded bar 463 which resides between the rails 458, 460 and is supported on the bed element 456 for rotation about its lengthwise axis 464. The bar 463 is threaded within a sleeve 466 depending from the carriage 438. The threaded bar 463 is mounted on the frame 432 so that it remains stationary in a lengthwise direction relative to the bed element 456. As a result, rotation of the threaded bar 463 effects a translatory movement of the carriage 438. The carriage 438 is connected to the stopper element 426 so that the stopper element 426 follows axial movement of the carriage 438.

Rotation of the threaded bar 463 can be effected through a motor 468 having an output shaft 470. A belt/chain 472 is trained around the shaft 470 and the threaded bar 463 so that rotation of the shaft 470 imparts a rotative force to the threaded bar 463. The motor 468 can be an electric motor, an hydraulic motor, or the like. In the event an hydraulic motor is utilized, fluid supply lines 474 are used to convey fluid to and from a fluid supply 475.

An optional crank handle 476 is connected to the threaded bar 463 and allows manual rotation of the threaded bar 463 to thereby reposition the carriage 438 and stopper element 426.

The stopper element 426 has a blocking surface 478 that is cylindrical over substantially its entire extent with a convex free end 480. With the stopper assembly 404 in the operative position and the stopper element 426 being advanced from the open position towards the closed position, the free end 480 guides the stopper element 426 against the insert surface 30 into the orifice 400. The stopper element 426 is advanced sufficiently that a substantial length of the uniform diameter outer surface 478 resides within the portion of the orifice 400 within the wall 446 that has a uniform diameter. The diameter of the surface 478 is slightly less than the diameter of the orifice 400 so as to create an annular gap. As a result, with the stopper element 426 in the closed position, the accumulated molten material in the space 420 is allowed to seep into the gap around the periphery of the surface 478 in the orifice 400. The refractory insert 427 remains sufficiently cool that the seeping molten material progressively solidifies in the gap between the surfaces 478, 430, thereby producing a leakproof seal. If the stopper element 426 were allowed to remain stationary in this closed position, the stopper element 426 would become fixed to the refractory insert 427.

Figure 18:
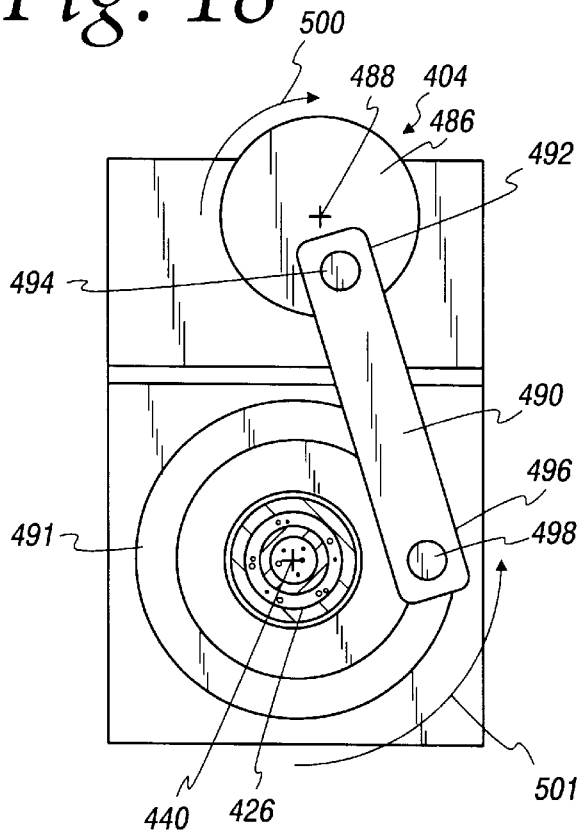
FIG. 18 is an enlarged, side elevation view of a repositioning mechanism for reciprocatingly moving the stopper element with the stopper element in the closed position and showing a state wherein the stopper element is being moved in one direction.
Figure 19:
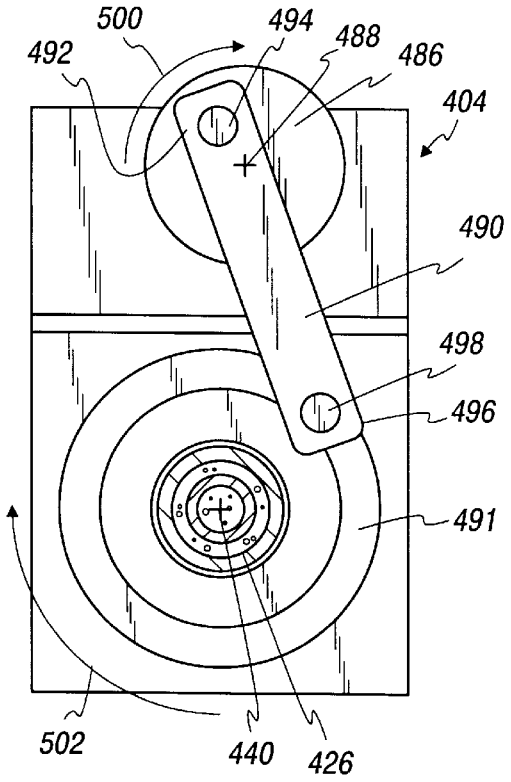
FIG. 19 is a view as in FIG. 18 with the stopper element being moved in the direction opposite to that in FIG. 18.

According to the invention, a repositioning mechanism is provided at 482 for continuously moving the stopper element 426 in the closed position within the refractory insert 427. The repositioning mechanism 482 continuously reciprocates the stopper element 426 about the axis 440, which is coincident with the axis 428 for the orifice 400 with the stopper element 426 in the closed position. To accomplish this, a motor 484 is mounted on the carriage 438 and is operated to rotate a disk 486 around an axis 488. A drive link 490 operatively connects between the disk 486 and a drive plate 491 attached to the stopper element 426. One end 492 of the drive link 490 is connected through a pivot pin 494 that is offset radially with respect to the axis 488. The opposite end 496 is attached through a pivot pin 498 to the drive plate 491 at a location radially offset from the axis 440. Rotation of the disk 486 through the motor 484 clockwise in the direction of the arrow 500 initially, as shown in FIG. 18, causes the link 490 to draw the plate 491 in a counterclockwise direction as indicated by the arrow 501. With the repositioning mechanism 482 in the state depicted in FIG. 19, the continued rotation of the disk 486 causes the drive link 490 to drive the plate 491 in a clockwise direction, as indicated by the arrow 502. This back and forth motion prevents the stopper element from becoming fixed within the refractory insert 427 by the solidified slag. At the same time, as the molten material progressively solidifies, the continuously moving surface 478 causes solidified material to form a seal that is closely conforming to the surface 478. A positive seal around the surface 478 thereby results. Since the stopper element 426 does not become fixed, it can be easily retracted to the open position to allow flow of molten material from the space 420 when desired.

The motor 484 can be of any type. It can be an electric motor or an hydraulic motor which operates from the hydraulic supply 475, or a separate supply.

Figure 17:
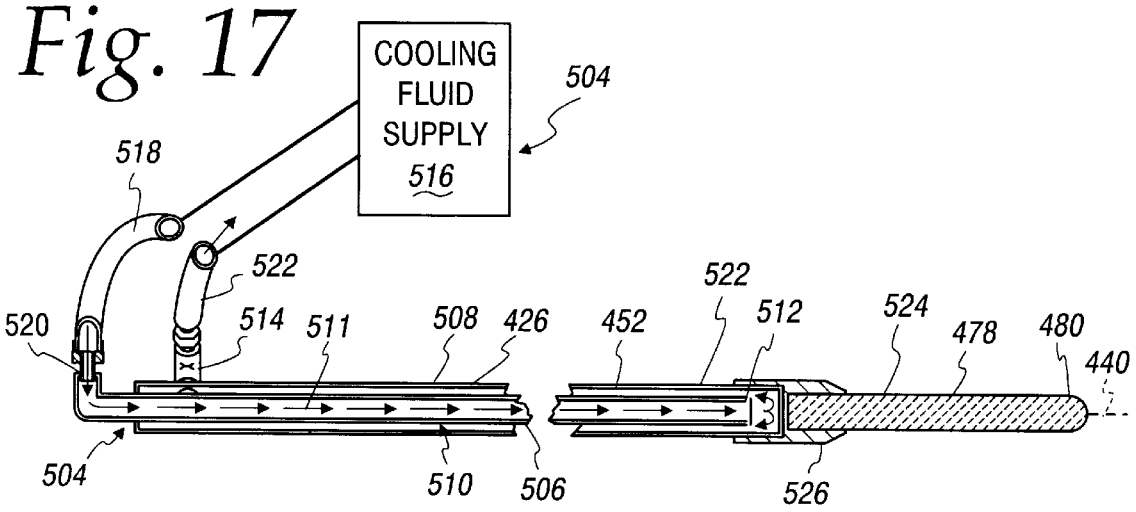
FIG. 17 is an enlarged, cross-sectional view of the stopper element on the stopper system of FIGS. 13–16.

Another aspect of the invention is the provision of a cooling system, as shown at 504 in FIG. 17. A delivery conduit 506 is concentrically located within an outer conduit 508 defining the body 452. An annular cooling space 510 is defined between the conduits 506, 508. With this arrangement, a cooling passageway is defined as indicated by the arrows 511 through the delivery conduit 506 around the free end 512 thereof to and through the cooling space 510 to an outlet 514. Cooling fluid from a supply 516 is delivered in a predetermined path via a conduit 518 to an inlet 520 on the delivery conduit 506 and is returned from the outlet 514 through a separate conduit 522 to the supply 516. With this arrangement, cooling fluid can be continuously circulated through the stopper element body 452. The cooling fluid could be air or a liquid, such as water.

In the embodiment in FIG. 17, the stopper element body 452 has two primary pars, with a first part 522 defining the cooling passageway and a second part 524 defining the blocking surface 478. A coupling 526 is used to join the parts 522, 524. The second part 524 is preferably separable from the coupling 526 to facilitate its replacement when it becomes worn.

In the embodiment shown in FIG. 17, the second part 524 is made from a ceramic material. It has been found through early experimentation that the use of ceramic material obviates the need for an internal reinforcing structure for the part 524.

Figure 20:
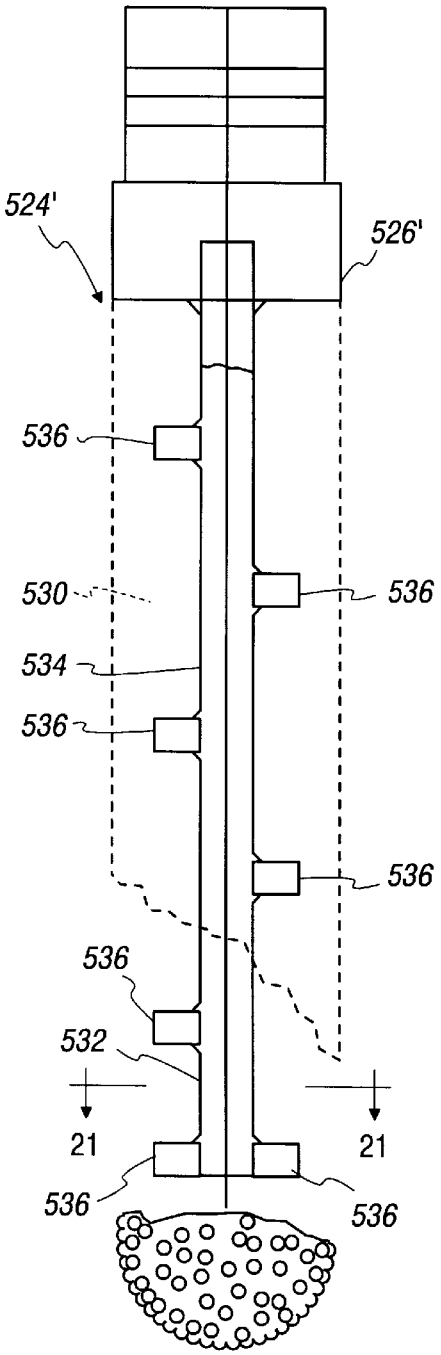
FIG. 20 is an enlarged, side elevation view of a reinforcing structure for another form of stopper element.
Figure 21:
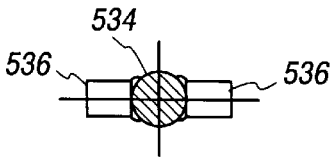
FIG. 21 is a cross-sectional view of the reinforcing structure taken along line 21—21 of FIG. 20.

As an alternative to using a ceramic material, a refractory material 530 can be used to define a corresponding second part 524', as shown in FIGS. 20 and 21. In this embodiment, a reinforcing element 532 is used and projects from a corresponding coupling 526'. The reinforcing element 532 has a cylindrical body 534 welded to the coupling 526' to project in cantilever fashion therefrom. A plurality of fins 536 are welded to the body 534 and are in staggered relationship both circumferentially and lengthwise of the body 534. The refractory material can be formed directly around the reinforcing element 532 to produce the same configuration as for the part 524.

Another feature of the invention is the provision of a sighting tube 540 which allows the position of the stopper element 426 to be observed from externally of the waste disposal system 402. This facilitates the necessary adjustment and monitoring of the condition of the system.

The foregoing disclosure of specific embodiments is intended to be illustrative of the broad concepts comprehended by the invention.

I claim:

1. In combination:

a) a vessel comprising a wall defining a storage space for a supply of a flowable material and an orifice on the wall communicating from the storage space through the body to externally of the storage space; and b) a stopper assembly for selectively blocking the orifice, said stopper assembly comprising:

a frame;

a stopper element with a blocking surface on the frame that is movable relative to the vessel between i) a closed position wherein the blocking surface substantially blocks the orifice and ii) an open position; and a repositioning mechanism for moving the stopper element relative to the vessel with the stopper element remaining in the closed position to thereby avoid fixing of the stopper element to the vessel.

2. The combination according to claim 1 wherein the orifice has a central axis and the stopper element moves substantially parallel to the central axis of the orifice between the open and closed positions.

3. The combination according to claim 1 wherein the orifice has a central axis and an axial extent and the orifice has a non-uniform cross section as viewed in cross section taken transversely to the central axis along the axial extent of the orifice.

4. The combination according to claim 1 wherein the orifice is bounded by a surface and with the stopper element in the closed position there is a gap between the blocking surface on the stopper element and the surface bounding the orifice.

5. The combination according to claim 4 wherein the surface bounding the orifice is annular and has a central axis, the blocking surface of the stopper is cylindrical and has a central axis, and the central axes of the surface bounding the orifice and the blocking surface of the stopper are substantially coincident.

6. The combination according to claim 1 wherein the stopper element has a free end and the blocking surface of the stopper element is convex at the free end of the stopper element.

7. The combination according to claim 1 wherein the repositioning mechanism moves the stopper element relative to the vessel in a reciprocating path.

8. The combination according to claim 1 wherein the stopper element is movable in substantially a straight line between the open and closed positions and the repositioning mechanism pivots the stopper element relative to the vessel around the straight line with the stopper element in the closed position.

9. The combination according to claim 1 wherein the stopper element has a body and the stopper element body comprises at least one of a refractory material and a ceramic material.

10. The combination according to claim 1 wherein the stopper element has a body with a passageway therethrough defining a predetermined path for the flow of a cooling liquid in heat exchange relationship with the stopper element body.

11. The combination according to claim 10 in combination with an inlet and an outlet in communication with the passageway and a supply of cooling fluid under pressure that moves through the inlet to and through the passageway to the outlet.

12. The combination according to claim 1 wherein the stopper element has a body, and the body comprises a separable portion on which the blocking surface is defined.

13. The combination according to claim 1 in combination with a molten material in the vessel storage space.

14. A stopper assembly for an orifice on a vessel, said stopper assembly comprising:

a frame;

a stopper element with a blocking surface on the frame that is movable relative to the frame between i) a closed position wherein the blocking surface is situated to block an orifice on a vessel and ii) an open position wherein the blocking surface is retracted from the first position; and a repositioning mechanism for moving the stopper element relative to the frame with the stopper element remaining in the closed position to thereby avoid fixing of the stopper element to a vessel.

15. The combination according to claim 14 wherein the stopper element moves in substantially a straight line between the open and closed positions.

16. The combination according to claim 15 wherein the repositioning mechanism pivots the stopper element around the straight line.

17. The combination according to claim 16 wherein the repositioning mechanism moves the stopper element in a reciprocating path.

18. The combination according to claim 14 wherein the blocking surface is substantially cylindrical.

19. The combination according to claim 14 wherein the blocking element has a free end and the blocking surface is convex at the free end of the stopper element.

20. The combination according to claim 14 wherein the stopper element has a body and the stopper element body comprises at least one of a refractory material and a ceramic material.

21. The combination according to claim 14 wherein the stopper element has a body with a passageway therethrough defining a predetermined path for the flow of a cooling liquid in heat exchange relationship with the stopper element body.

22. The combination according to claim 21 in combination with an inlet and an outlet in communication with the passageway and a supply of cooling fluid under pressure that moves through the inlet to and through the passageway to the outlet.

* * * * *